US007152674B2

(12) United States Patent
Bowles

(10) Patent No.: US 7,152,674 B2
(45) Date of Patent: Dec. 26, 2006

(54) DISCONNECT DEVICES

(75) Inventor: Rodney Gordon Bowles, Yarmouth (GB)

(73) Assignee: Weatherford/Lamb, Inc., Houston, TX (US)

( * ) Notice: Subject to any disclaimer, the term of this patent is extended or adjusted under 35 U.S.C. 154(b) by 221 days.

(21) Appl. No.: 10/433,270

(22) PCT Filed: Nov. 27, 2001

(86) PCT No.: PCT/GB01/05233

§ 371 (c)(1),
(2), (4) Date: Oct. 6, 2003

(87) PCT Pub. No.: WO02/44513

PCT Pub. Date: Jun. 6, 2002

(65) Prior Publication Data

US 2004/0045704 A1 Mar. 11, 2004

(30) Foreign Application Priority Data

Nov. 29, 2000 (GB) ..... 0029097.3

(51) Int. Cl.
*E21B 17/02* (2006.01)
*E21B 17/06* (2006.01)

(52) U.S. Cl. ..... 166/242.6; 166/377; 285/86; 285/83; 285/304; 175/423

(58) Field of Classification Search ..... 285/34, 285/83, 86, 304, 306, 922; 166/242.6, 377; 175/423

See application file for complete search history.

(56) References Cited

U.S. PATENT DOCUMENTS 2,843,399 A * 7/1958 Arterbury et al. ..... 285/3
2,988,145 A 6/1961 Clark ..... 175/317
3,753,471 A 8/1973 Kammerer et al. ..... 175/320
3,842,914 A * 10/1974 Mott ..... 166/377

(Continued)

FOREIGN PATENT DOCUMENTS

GB 2334047 8/1999

(Continued)

OTHER PUBLICATIONS

British Search Report dated Mar. 5, 2002, for application No. GB 0128336.5.

(Continued)

*Primary Examiner*—David Bagnell
*Assistant Examiner*—Shane Bomar
(74) *Attorney, Agent, or Firm*—Patterson & Sheridan, LLP

(57) ABSTRACT

A disconnect device for use as part of a tubing string downhole in an oil or gas well and which comprises a tubular body, at least one slip held within the tubular body, and a sleeve housed within the tubular body to hold the at least one slip in coupling engagement with at least one of a coupling component of an upper sub and a coupling component of a lower sub, in use, the sleeve being selectively moveable relative to the at least one slip to release the slip and thereby release the coupling, wherein the slip cooperatively engages with at least one of the coupling component of the upper sub and the coupling component of the lower sub by means of at least one localized protrusion on the slip or on the coupling component extending into a corresponding shaped local depression or hole in the other of the at least one slip and the coupling component whereby tensile load and torque may be transmitted by the coupling, that part of the device which is to be released and left downhole by releasing the coupling engagement having a fishneck configuration to enable subsequent retrieval by a fishing tool.

19 Claims, 5 Drawing Sheets

U.S. PATENT DOCUMENTS

| | | | | | |
|---|---|---|---|---|---|
| 4,289,202 | A | * | 9/1981 | Henderson | 166/212 |
| 4,449,736 | A | * | 5/1984 | Blackwell | 285/3 |
| 4,601,492 | A | * | 7/1986 | George | 285/3 |
| 4,877,085 | A | * | 10/1989 | Pullig, Jr. | 166/98 |
| 4,915,423 | A | * | 4/1990 | Wallace | 285/91 |
| 4,984,632 | A | * | 1/1991 | Sampa et al. | 166/237 |
| 5,040,598 | A | * | 8/1991 | Pleasants | 166/98 |
| 5,092,364 | A | * | 3/1992 | Mullins | 137/614.05 |
| 5,123,489 | A | * | 6/1992 | Davis et al. | 166/377 |
| 5,127,482 | A | * | 7/1992 | Rector, Jr. | 175/321 |
| 5,242,201 | A | * | 9/1993 | Beeman | 294/86.17 |
| 5,257,663 | A | | 11/1993 | Pringle et al. | 166/66.4 |
| 5,419,399 | A | | 5/1995 | Smith | 166/377 |
| 5,526,888 | A | * | 6/1996 | Gazewood | 175/320 |
| 5,605,366 | A | * | 2/1997 | Beeman | 294/86.28 |
| 5,718,291 | A | | 2/1998 | Lorgen et al. | 166/377 |
| 5,787,982 | A | | 8/1998 | Bakke | 166/242.6 |
| 5,810,088 | A | | 9/1998 | Lamirand et al. | 166/377 |
| 5,984,029 | A | | 11/1999 | Griffin et al. | 175/321 |
| 6,053,262 | A | * | 4/2000 | Ferguson et al. | 175/321 |
| 6,131,953 | A | | 10/2000 | Connell et al. | 285/3 |
| 6,186,249 | B1 | * | 2/2001 | Bjornstad | 175/320 |
| 6,213,206 | B1 | * | 4/2001 | Bakke | 166/242.7 |
| 6,318,470 | B1 | * | 11/2001 | Chang et al. | 166/377 |
| 6,408,946 | B1 | * | 6/2002 | Marshall et al. | 166/317 |
| 6,439,305 | B1 | * | 8/2002 | Bakke | 166/242.6 |
| 6,450,541 | B1 | * | 9/2002 | Bakke | 285/2 |
| 6,474,701 | B1 | * | 11/2002 | Bowles et al. | 285/382.1 |
| 6,629,563 | B1 | * | 10/2003 | Doane | 166/125 |
| 6,908,118 | B1 | * | 6/2005 | Fumioka | 285/277 |
| 6,923,256 | B1 | * | 8/2005 | Parker | 166/242.7 |
| 7,036,602 | B1 | * | 5/2006 | Turley et al. | 166/387 |

FOREIGN PATENT DOCUMENTS

| | | |
|---|---|---|
| GB | 2355050 | 4/2001 |
| GB | 2361727 | 10/2001 |
| WO | WO 97/29270 | 8/1997 |
| WO | WO 98/30823 | 7/1998 |
| WO | WO 98/32946 | 7/1998 |

OTHER PUBLICATIONS

PCT International Search Report dated Mar. 15, 2002, for application No. PCT/GB01/05233.

* cited by examiner

DISCONNECT DEVICES

CROSS-REFERENCE TO RELATED APPLICATIONS

This application is the National Stage of International Application No. PCT/GB01/05233, filed on Nov. 27, 2001, and published under PCT Article 21(2) in English, and claims priority of Great Britain Application No. 0029097.3, filed on Nov. 29, 2000. The aforementioned related patent applications are herein incorporated by reference in their entirety.

BACKGROUND OF THE INVENTION

1. Field of the Invention

The present invention relates to disconnect devices—releasable connectors—that are used downhole in oil or gas wells. The invention is particularly, though not necessarily exclusively, relevant to hydraulic disconnects as are used in coiled tubing workstrings to release the bottom hole assembly of the workstring in a controlled fashion.

2. Description of the Related Art

Hydraulic disconnect devices have been in use for many years and usually work along the following basis. Referring to FIG. 1 of the accompanying drawings, here the disconnect device takes the form of a tubular body 2 that is an intermediate sub between an upper sub 1 and lower sub 3 of the workstring. This tubular body, or intermediate sub, 2 accommodates a tubular mandrel/bobbin 4 extending along its bore and which is retained in an initial position as illustrated by shear screws/pins 5. This mandrel/bobbin 4 in its initial position cooperatively engages with and thereby supports a collet 6 that is integrally assembled with the lower sub 3 and thereby the upper sub 1 supports the lower sub 3 by the mandrel 4 and collet 6. The collet 6 takes tensile loads on the workstring, preventing the disconnect from being parted during normal use of the workstring until the disconnect is actuated by hydraulic control.

In order for the disconnect to have torsional capabilities as well as transferring tensile loads, special keying castellations need to be provided on the tool.

To actuate the disconnect to release the joint, a steel ball 7 is dropped down the bore of the workstring to fall the level of the disconnect device and seat on the top of the bobbin/mandrel 4, blocking the bore of the mandrel 4 and forming a pressure tight seal against it so that when fluid pressure is applied over the mandrel 4 this acts over the diameter of the seal and the applied force shears the shear pins/screws 5, allowing the mandrel 4 to move downwards to its second position. When the mandrel 4 is in its second position, undercuts that are provided within the mandrel 4 are aligned with protrusions on the fingers of the collet 6 whereby the mandrel 4 no longer supports the collet 6 and the joint is able to be parted. The lower sub 3 and associated components are left down hole as the workstring is retracted. They can subsequently be retrieved using standard fishing tools that are able to latch in the profile previously occupied by the collet 6. However, the castellations provided on the body associated with the lower sub 3 can be obstructive and interfere with the attempts to fish out the bottom hole assembly.

In another prior art system (not illustrated) the disconnect device has, instead of a collet, a set of turned slips that are supported on a mandrel accommodated in the bore of the disconnect body. These slips are generally formed by splitting a tubular component into segments, the component having been turned through 360° to provide a circumferential recess. These slips are more compact, needing less workstring length, than the corresponding collet-based prior art system. They are arranged to locate into a secondary internal profile and hence when parted give a clean fresh fishneck profile for future retrieval operations. As with the collet system, however, because they have a turned, 360° circumferential, profile they lack any torsional capacity and are accordingly provided with keying castellations. As with the collet-based device, these castellations can interfere with fishing operations.

SUMMARY OF THE INVENTION

According to a first aspect of the present invention there is provided a disconnect device for use as part of a tubing string downhole in an oil or gas well and which comprises a tubular body, at least one slip held within the tubular body, and a sleeve housed within the tubular body to hold the at least one slip in coupling engagement with at least one of a coupling component of an upper sub and a coupling component of a lower sub, in use, the sleeve being selectively moveable relative to the at least one slip to release the slip and thereby release the coupling, wherein the slip cooperatively engages with at least one of the coupling component of the upper sub and the coupling component of the lower sub by means of at least one localised protrusion on the slip or on the coupling component extending into a correspondingly shaped local depression or hole in the other of the at least one slip and the coupling component whereby tensile load and torque may be transmitted by the coupling, that part of the device which is to be released and left downhole by releasing the coupling engagement having a fishneck configuration to enable subsequent retrieval by a fishing tool.

Notably the or each depression or hole is a local depression or hole, i.e. it does not extend as a notch or groove around the full circumference' of the coupling component or slip assembly.

Preferably the at least one protrusion is substantially convex and the at least one correspondingly shaped depression or hole is concave. The at least one depression or hole is concave and the at least one protrusion is correspondingly convex, contributing to the strength and integrity of the connection formed between the depression or hole and protrusion axially and rotationally, while facilitating makeup of the connection and limiting wear.

Preferably, the device has a said at least one depression in the at least one of the coupling components or the slip, the depression or protrusion suitably being formed by plastic deformation of the material of the coupling component or slip.

The device suitably has three or more said protrusions and corresponding depressions or holes at circumferentially spaced intervals around the tubular body.

Suitably the at least one slip has a localised protrusion on its internal diameter which cooperatively engages with a corresponding hole or depression in the outside diameter of the corresponding coupling component.

Preferably the at least one slip has, at a first end thereof, at least one localised protrusion or depression to cooperatively engage with a corresponding localised depression or protrusion, respectively, on an upper sub coupling component and has, at a second end thereof, at least one localised protrusion or depression to cooperatively engage with a corresponding localised depression or protrusion, respectively, of a lower sub coupling component.

The device preferably comprises a said upper sub and lower sub with said tubular body therebetween as an intermediate sub.

Suitably the sleeve housed within the tubular body ensheathes the at least one slip. Preferably this sleeve is adapted to be left downhole following release of the connection and has the fishneck configuration formed therein.

According to a second aspect of the present invention there is provided a releasable connector for releasably connecting a first tube of tubing string for use downhole in oil and gas well operations with a second tube of tubing string, the releasable connector comprising a connector body housing at least one slip, and a sleeve housed within the tubular body to hold the slip in coupling engagement with at least one of the first tube of tubing string and the second tube of tubing string, in use, the sleeve being selectively moveable relative to the at least one slip to release the slip and thereby release the coupling, wherein the slip cooperatively engages with the first tube of tubing string and the second tube of tubing string by means of at least one localised protrusion on the slip or on the first or second tube extending into a correspondingly shaped local depression in the other of the at least one slip and the first or second tube.

BRIEF DESCRIPTION OF THE DRAWINGS

A preferred embodiment of the present invention will now be more particularly described, by way of example, with reference to the accompanying drawings, wherein.

DETAILED DESCRIPTION

Figure 1:
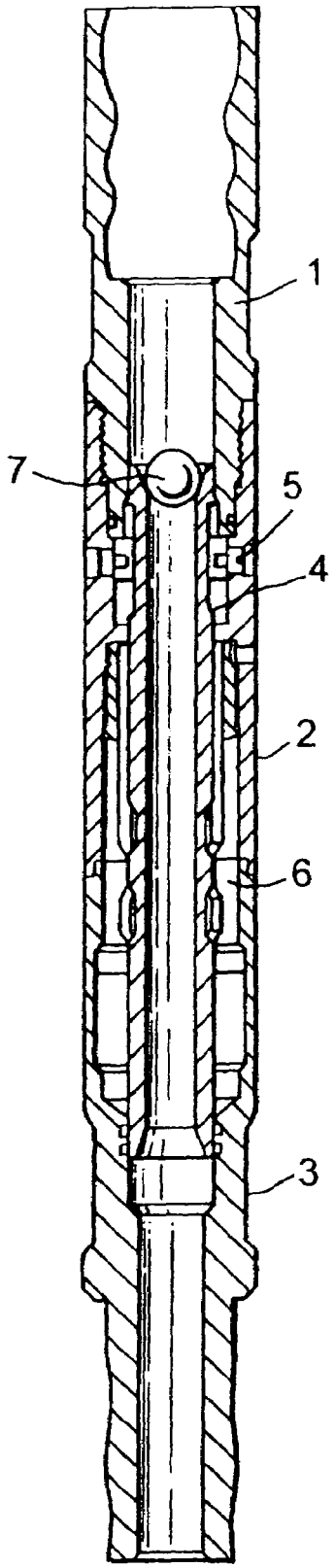
Fig.1 PRIOR ART
FIG. 1 shows a prior art disconnect.

Referring to FIGS. 2 to 8, the preferred embodiment of disconnect tool has an overall configuration that is similar to that of the prior art disconnect tool of FIG. 1 in having a top sub 1, intermediate sub/tubular disconnect body 2 and lower/bottom sub 3. The device of the present invention also has a tubular coupling component that extends within the bore of the intermediate sub/disconnect body 2 and which is releasably coupled to the lower sub 3. The disconnect tool/device of the present invention, however, has no collet but instead has a slip assembly 8, the upper in use end of which cooperatively engages with a lower in use end of a tubular coupling component, or mandrel, 9 threaded to the top sub 1. The lower in use end of the slip assembly 8 couples with an upper in use end of a similar tubular component 11 extending upwardly from the lower sub 3. The tubular coupling component 11 of the lower sub 3 is formed integrally with the lower sub 3.

The slip assembly 8 is suitably formed as two or more and preferably three segments that assemble around the lower in use end of the coupling component 9 of the top sub 1 and the upper in use end of the coupling component 11 of the lower sub 3 as a sheath encircling them and which is in turn ensheathed within a sleeve 10. When the slip 8 segments are mounted in place to cooperatively engage with the respective upper and lower tubular coupling components 9, 11, they are held in place by the sleeve 10 which in turn is closely accommodated within the bore of the intermediate sub/tubular disconnect body 2.

Figure 2A:
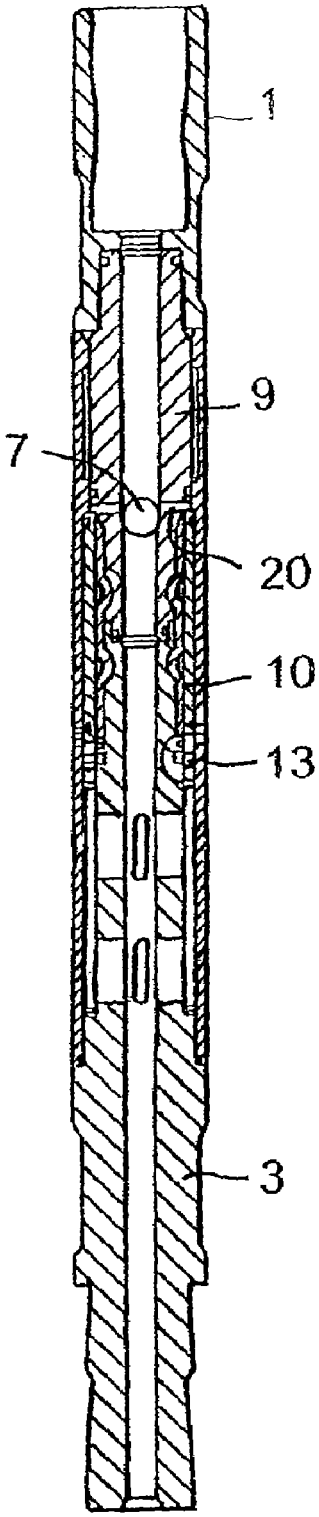
FIGS. 2A and 2B are, respectively, longitudinal sectional views of the preferred embodiment of disconnect device in an initial coupled state and in a second released state.

The sleeve 10 is fixed in place longitudinally of the disconnect body 2 by shear pins 13 which lock the connection in the coupled state, as illustrated in FIG. 2A.

Unlike conventional disconnect devices, the device of the present invention has highly distinctive slips which cooperatively engage with the tubular coupling components of the top sub 1 and bottom sub 3 by means of dimple-shaped protrusions on the slip or on the connector component which cooperatively engage with corresponding dimple-shaped recesses on the other.

As illustrated, the slip assembly 8 (see FIG. 3) is formed with a plurality of dimple depressions formed from the outside of the slip assembly by locally pressing several steel balls or the like, for example, into the outer face of the slip assembly 8, whereby the radially inner face of the slip assembly 8 is deformed to have a plurality of dimple-shaped protrusions 18 extending radially inwardly. These engage, in use, with corresponding dimple-shaped recesses 19 in the radially outer face of the upper and lower coupling components (see FIGS. 6 and 7). The slip assembly 8 may alternatively be cast or otherwise formed to have the desired integral protrusions 18. The recesses 19 are suitably pre-machined into the upper and lower coupling components 9, 11. In an alternative. embodiment the protrusions 18 may be provided on the upper and lower coupling components.

By use of local, suitably dimple-shaped, protrusions to engage in correspondingly shaped recesses, the releasable connection formed is able to transmit not only tensile load but also torque without the need for provision of separate keying castellations and without keying splines or lugs that are independent and vulnerable to damage.

Figure 2B:
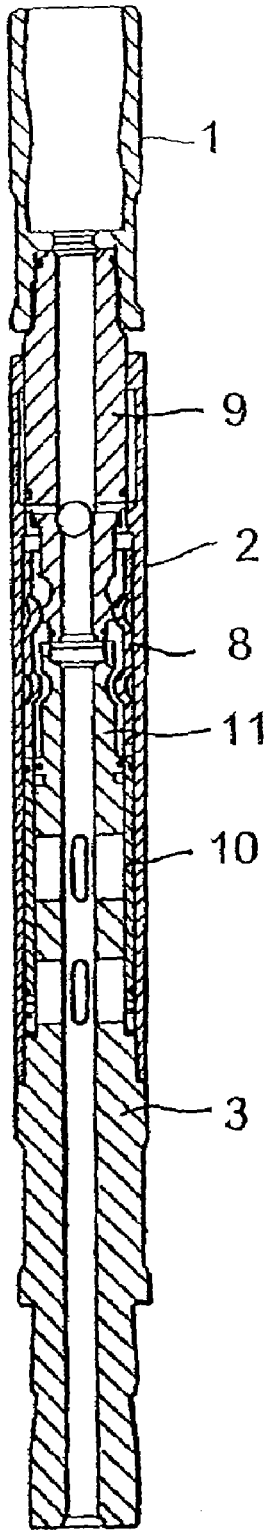
Figure 3A:
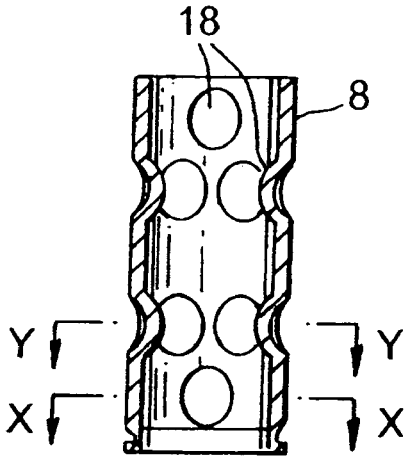
FIGS. 3A–3D are, respectively, a longitudinal sectional view of a disconnect dog (slip assembly) of the disconnect device, a side elevation view of the same and transverse sectional views taken along the lines X—X and Y—Y.
Figure 3B:
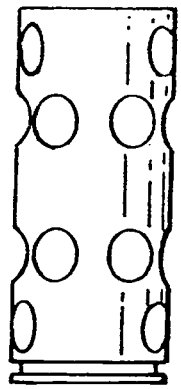
Figure 3C:
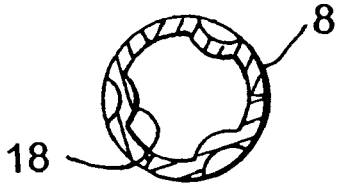
Figure 3D:
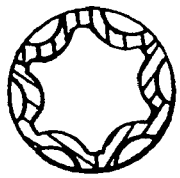
Figure 4:
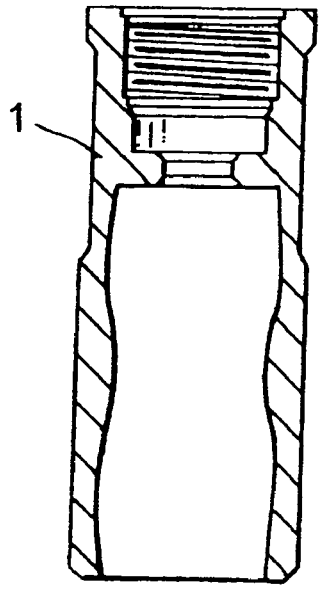
FIG. 4 is a longitudinal sectional view of the top sub of the device.
Figure 5:
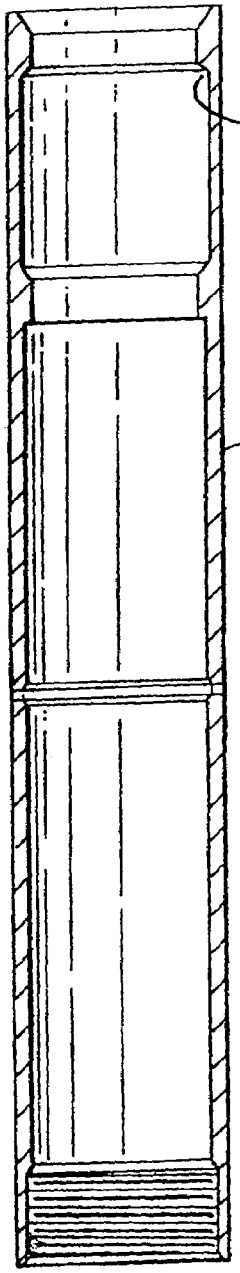
FIG. 5 is a longitudinal sectional view of the tubular body of the device.
Figure 6A:
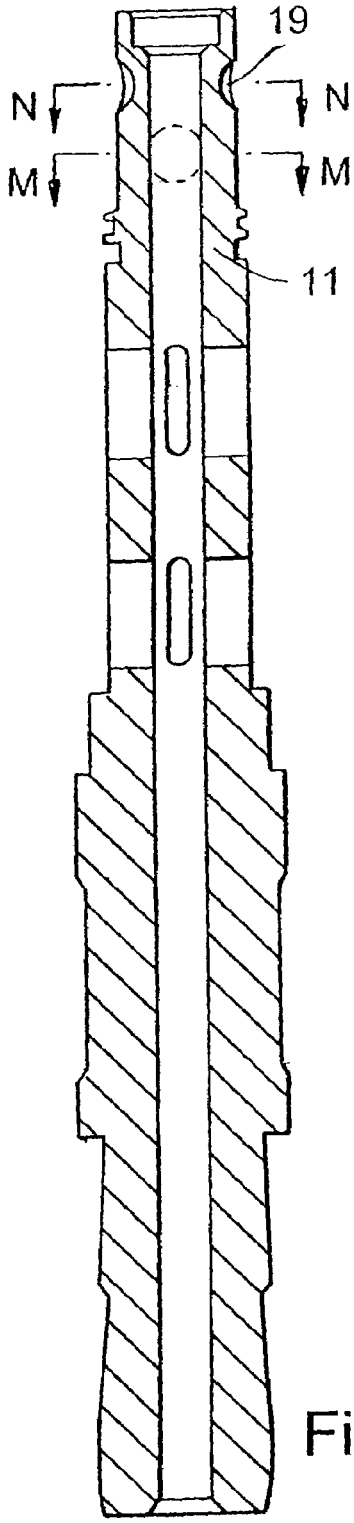
FIGS. 6A, 6B and 6C are, respectively, a longitudinal sectional view of the bottom sub of the device and transverse sectional views taken along the lines M—M and N—N.
Figure 6B:
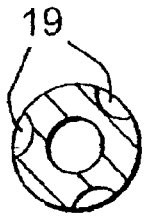
Figure 6C:
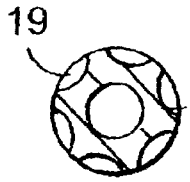
Figure 7A:
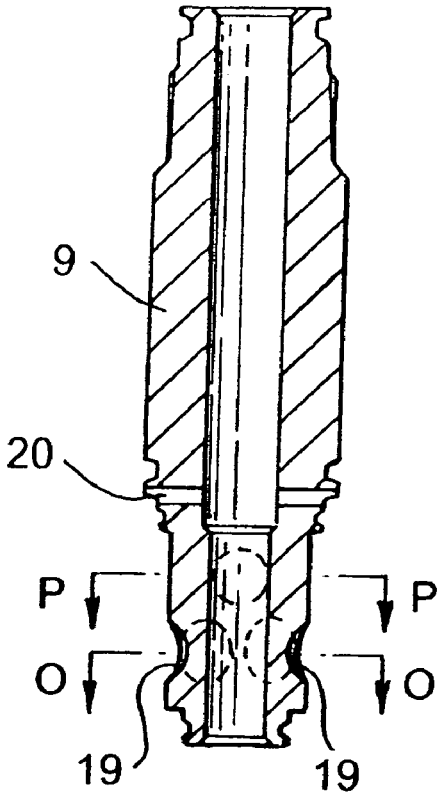
FIGS. 7A, 7B and 7C are, respectively, a longitudinal sectional view of a mandrel of the disconnect device and transverse sectional views of the same taken along the lines O—O and P—P.
Figure 7B:
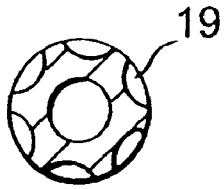
Figure 7C:
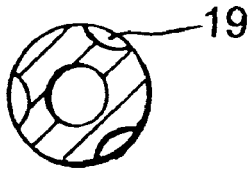
Figure 8:
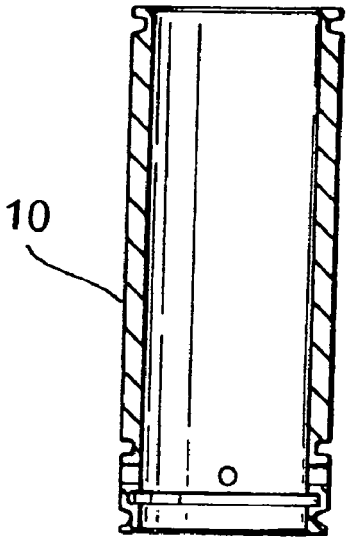
FIG. 8 is a longitudinal sectional view of a sleeve of the disconnect device.

To release the releasable connection, as with the prior systems, a ball 7 may be dropped down the bore of the workstring to lodge against a seat formed within the bore of the disconnect tool, whereby applying hydraulic fluid pressure down the bore of the workstring will lead to hydraulic pressure being diverted laterally from the drop ball 7 that now occludes the bore of the tool out through lateral channels 20 in the upper coupling component 9. The pressure of the diverted hydraulic fluid acts on the upper end edge of the sleeve 10 causing the shearpin 13 to shear and the sleeve 10 to shift longitudinally downwardly within the tubular body 2 to its second, released, position as indicated in FIG. 2B and whereupon the slip assembly 8 is no longer constrained in position, moves radially outwardly, the segments moving apart and allows the component of the top sub 1 to become decoupled from the coupling component 11 of the bottom sub 3.

When the disconnect tool is in the second/release position, pressure integrity is lost and the operator will see a drop in pressure indicative of movement of the sleeve 10. As usual, the upper part of the toolstring may be retracted complete with the top sub 1 and associated coupling component 9 and drop ball 7, leaving the bottom sub 3 with a clean fishing neck 30 (being a configuration of the bore of the tool having a narrowing defining a lip/shoulder against which a standard fishing tool may engage). This fishing neck 30 has not previously seen tensile load and is free from any keying castellations or the like which would otherwise make fishing for and retrieval of the bottom hole assembly awkward.

Although in the above described embodiment of the invention the slips and sleeve are left downhole, in alternative embodiments the device may be configured for retrieval of the slips and/or sleeve with the upper sub of the toolstring, suitably by linking the slips and/or sleeve to the upper sub/upper coupling component of the device. In such embodiment the fishing neck 30 would be provided on the sleeve rather than on the bottom sub.

While the foregoing is directed to embodiments of the present invention, other and further embodiments of the invention may be devised without departing from the basic scope thereof, and the scope thereof is determined by the claims that follow.

The invention claimed is:

1. A disconnect device for use as part of a tubing string downhole in an oil or gas well and which comprises:

a tubular body, at least one slip held within the tubular body, and a sleeve housed within the tubular body to hold the at least one slip in coupling engagement with a coupling component of an upper sub and a coupling component of a lower sub, in use, the sleeve being selectively moveable relative to the at least one slip to release the at least one slip and thereby release the coupling, wherein the at least one slip includes at least one localized protrusion disposed on an inner diameter of the at least one slip which cooperatively engages with a corresponding localized depression or hole disposed on an outer diameter of at least one of the coupling component of the upper sub and the coupling component of the lower sub whereby tensile load and torque is transmitted by the coupling, that part of the device which is to be released and left downhole by releasing the coupling engagement having a fishneck configuration to enable subsequent retrieval by a fishing tool.

2. A device as claimed in claim 1, wherein the at least one protrusion is substantially convex and the at least one correspondingly shaped depression or hole is concave.

3. A device as claimed in claim 1, wherein the at least one depression or hole is substantially circular.

4. A device as claimed in claim 1, the depression or protrusion being formed by plastic deformation of the material of the coupling component or slip.

5. A device as claimed in claim 1, wherein the device has three or more protrusions and corresponding depressions or holes at circumferentially spaced intervals around the tubular body.

6. A device as claimed in claim 1, wherein the at least one slip has, at a first end thereof, at least one of the localized protrusion or depression to cooperatively engage with the corresponding localized depression or protrusion, respectively, on the upper sub coupling component and has, at a second end thereof, at least one of the localized protrusion or depression to cooperatively engage with the corresponding localized depression or protrusion, respectively, of the lower sub coupling component.

7. A device as claimed in claim 1, wherein the tubular body functions as an intermediate sub between the upper sub and the lower sub.

8. A device as claimed in claim 1, wherein the sleeve housed within the tubular body ensheathes the at least one slip.

9. A device as claimed in claim 7, wherein the sleeve is adapted to be left downhole following release of the connection and has the fishneck configuration formed therein.

10. A releasable connector for connecting a first wellbore tubular and a second wellbore tubular, comprising:

a tubular body;

a slip disposed in the tubular body and having formations for engagement with mating formations on an outside surface of the first and second wellbore tubulars; and a sleeve disposed in the tubular body and selectively moveable between a first position and a second position, wherein the sleeve in the first position retains the formations of the slip in a coupling engagement with the mating formations thereby connecting the first wellbore tubular and the second wellbore tubular, and wherein the sleeve in the second position releases the coupling engagement, and wherein the coupling engagement transmits tensile load and torque between the first and second wellbore tubulars.

11. The releasable connector of claim 10, wherein the sleeve comprises a fishing neck.

12. The releasable connector of claim 10, wherein one of the tubulars comprises a fishing neck.

13. The releasable connector of claim 10, wherein the formations are protrusions and the mating formations are shaped recesses.

14. The releasable connector of claim 10, wherein the sleeve in the first position is disposed substantially between the slip and the tubular body.

15. A releasable connector for connecting a first tubular and a second tubular, comprising:

a tubular body;

a slip disposed in the tubular body and having formations for engagement with mating formations on an outside surface of the first and second tubulars; and a sleeve disposed in the tubular body and selectively moveable between a first position and a second position, wherein the sleeve in the first position retains the formations of the slip in a coupling engagement with the mating formations thereby connecting the first tubular and second tubular, wherein the sleeve in the second position releases the coupling engagement, and wherein the sleeve comprises a fishing neck.

16. A releasable connector for connecting a first tubular and a second tubular, comprising:

a tubular body;

a slip disposed in the tubular body and having formations for engagement with mating formations on an outside surface of the first and second tubulars; and a sleeve disposed in the tubular body and selectively moveable between a first position and a second position, wherein the sleeve in the first position retains the formations of the slip in a coupling engagement with the mating formations thereby connecting the first tubular and second tubular, wherein the sleeve in the second position releases the coupling engagement, and the coupling engagement transmits tensile load and torque between the first and second tubulars.

17. A disconnect device for use as part of a tubing string downhole in an oil or gas well and which comprises:

a tubular body, at least one slip held within the tubular body, and a sleeve housed within the tubular body to hold the at least one slip in coupling engagement with a coupling component of an upper sub and a coupling component of a lower sub, in use, the sleeve being selectively moveable relative to the at least one slip to release the at least one slip and thereby release the coupling, wherein the at least one slip cooperatively engages with at least one of the coupling component of the upper sub and the coupling component of the lower sub using at least one localized protrusion on the at least one slip or on the coupling component extending into a correspondingly shaped local depression or hole in the other of the at least one slip and the coupling component whereby tensile load and torque is transmitted by the coupling, that part of the device which is to be released and left downhole by releasing the coupling engagement having a fishneck configuration to enable subsequent retrieval by a fishing tool, wherein the sleeve housed within the tubular body ensheathes the at least one slip.

18. A releasable connector for connecting a first wellbore tubular and a second wellbore tubular, comprising:

a tubular body;

a slip disposed in the tubular body and having formations for engagement with mating formations on an outside surface of the first and second wellbore tubulars; and a sleeve comprising a fishing neck disposed in the tubular body and selectively moveable between a first position and a second position, wherein the sleeve in the first position retains the formations of the slip in a coupling engagement with the mating formations thereby connecting the first wellbore tubular and second wellbore tubular, and wherein the sleeve in the second position releases the coupling engagement.

19. A releasable connector for connecting a first wellbore tubular and a second wellbore tubular, comprising:

a tubular body;

a slip disposed in the tubular body and having formations for engagement with mating formations on an outside surface of the first and second wellbore tubulars; and a sleeve disposed in the tubular body and selectively moveable between a first position and a second position, wherein the sleeve in the first position retains the formations of the slip in a coupling engagement with the mating formations thereby connecting the first wellbore tubular and second wellbore tubular, wherein the sleeve in the second position releases the coupling engagement, and wherein one of the tubulars comprises a fishing neck.

* * * * *